US010841714B2

(12) United States Patent
Mebus et al.

(10) Patent No.: US 10,841,714 B2
(45) Date of Patent: Nov. 17, 2020

(54) PROGRAMMABLE HEARING DEVICE AND METHOD OF PROGRAMMING A HEARING DEVICE

(71) Applicant: Oticon A/S, Smørum (DK)

(72) Inventors: Klaus Ruggaard Mebus, Smørum (DK); Henrik Nielsen, Smørum (DK); Franz Treue, Smørum (DK)

(73) Assignee: OTICON A/S, Smørum (DK)

( * ) Notice: Subject to any disclaimer, the term of this patent is extended or adjusted under 35 U.S.C. 154(b) by 97 days.

(21) Appl. No.: 16/027,640

(22) Filed: Jul. 5, 2018

(65) Prior Publication Data

US 2019/0014423 A1 Jan. 10, 2019

(30) Foreign Application Priority Data

Jul. 6, 2017 (EP) ..... 17179991

(51) Int. Cl.
*H04R 25/00* (2006.01)

(52) U.S. Cl.
CPC ..... *H04R 25/43* (2013.01); *H04R 25/30* (2013.01); *H04R 25/554* (2013.01); *H04R 25/70* (2013.01); *H04R 25/552* (2013.01); *H04R 2225/55* (2013.01)

(58) Field of Classification Search
CPC combination set(s) only.
See application file for complete search history.

(56) References Cited

U.S. PATENT DOCUMENTS

| | | | | |
|---|---|---|---|---|
| 9,877,123 | B2 * | 1/2018 | Pedersen | H04L 63/0823 |
| 2017/0006029 | A1 * | 1/2017 | Pedersen | H04W 4/80 |
| 2017/0006392 | A1 | 1/2017 | Pedersen et al. | |

FOREIGN PATENT DOCUMENTS

| | | | |
|---|---|---|---|
| EP | 3032857 | A1 | 6/2016 |
| WO | WO 2013/091693 | A1 | 6/2013 |

* cited by examiner

*Primary Examiner* — Amir H Etesam
(74) *Attorney, Agent, or Firm* — Birch, Stewart, Kolasch & Birch, LLP

(57) ABSTRACT

The invention relates to a hearing device that comprises a data interface for receiving data and a memory unit for storing data. The memory unit comprises a non-static section and a static section. The static section comprises a unique key that is unique for the specific hearing device. The hearing device further comprises a verifier that is configured to process the unique key and a second key contained in first type data received via the data interface in order to determine whether the second key needs a verification criterion with respect to the unique key. The verifier is further configured to discard received first type data in the non-static section of the memory unit if the second key contained in received data does not meet the verification criterion with respect to the unique key stored in the static section of the memory unit.

15 Claims, 2 Drawing Sheets

PROGRAMMABLE HEARING DEVICE AND METHOD OF PROGRAMMING A HEARING DEVICE

TECHNICAL FIELD

The invention relates to a hearing device having a data interface for receiving data and a memory unit for storing data. The invention further relates to a method of programming a hearing device.

BACKGROUND

Hearing devices, in particular hearing aids, are head-worn devices that assist a person wearing the hearing device in hearing. Hearing aids are used to compensate for a hearing loss of persons who are hard of hearing or hearing impaired. Various kinds of hearing aids are known. Hearing aids can for instance be implemented as behind the ear (BTE) devices, completely in the canal (CIC) devices, cochlear implants et cetera. Further, hearing aids can be binaural hearing aids. A binaural hearing aid typically comprises two devices, one for each ear of the hearing impaired person.

Hearing aids typically comprise one or more microphones for converting ambient sound into electric sound signals that can be processed by a processing unit. Hearing aids further typically comprise an output transducer, for example speaker, also called receiver, that converts an electric output signal into sound. The sound processor processes the electric input sound signal in order to generate an output signal for the output transducer that in turn converts the output signal in a user perceivable signal, for instance sound or stimulation pulses in a cochlear implant.

Hearing devices and in particular many hearing aids are nowadays programmable. These hearing devices comprise a data interface for receiving data and a memory unit for storing data. The data stored in the memory can be program data or other data. Since program data at least in part determines the operation of the hearing device it is necessary to ensure that program data received is fine for the particular hearing device. In case of a firmware update, it should be ensured that the firmware suits the particular hearing device.

SUMMARY

It is an object of the invention to provide a hearing device that can be programmed or updated online.

According to the present disclosure, a hearing device is provided which comprises a data interface for receiving data and a memory unit for storing data. The memory unit comprises a non-static section and a static section. The static section comprises a unique key that is unique for the specific hearing device. The hearing device further comprises a verifier that is configured to process the unique key and a second key contained in first type data received via the data interface in order to determine whether the second key fulfils a verification criterion with respect to the unique key. The verifier is further configured to discard received first type data in the non-static section of the memory unit if the second key contained in received data does not meet the verification criterion with respect to the unique key stored in the static section of the memory unit. Discarding data can include to prevent further storing of the received data or to prevent activating or using the received data.

The purpose of the present disclosure is for example to prevent unauthorized updates of the hearing device from a less expensive upgraded hearing device to a more expensive upgraded hearing device. For example, the hearing device may comprise technical features which allows for at least three price point configurations, such as a low priced configured hearing device, normal priced configured hearing device and a high priced configured hearing device. A user paying for a low priced configured hearing device may seek for an unauthorized update of its low priced configured hearing device to a more expensive upgrade of the hearing device. The present disclosure will prevent this from happening.

First type data may be any data or a particular kind of data, for instance data representing firmware. Apart from first type data, e.g. firmware, the data interface may be configured to receive second type data, for instance data representing stream music, data representing sound captured by a microphone or the like.

Preferably, the hearing device is configured to receive data packages comprising a header and payload data. The payload data may represent different types of data. The type of data of the payload data is indicated by data in the header of the data package.

The non static section of the memory unit may comprise volatile memory (Random Access Memory (RAM) or Static Random Access Memory (SRAM)), non-volatile memory, user programmable memory (for instance Erasable Programmable Read-Only Memory (EPROM) or Electrically Erasable Programmable Read-Only Memory (EEPROM or Flash ROM)), non-reprogrammable, read only memory (ROM) or a combination thereof.

The memory unit may comprise more than one partition. One partition may be reserved for data representing operation program code or operation parameter values.

In general, the static section may also comprise volatile memory, non-volatile memory, user programmable memory, non-reprogrammable, read only memory or a combination thereof. However, it is preferred that the static section comprises Electrically Erasable Programmable Read-Only Memory (EEPROM) or any other type of memory for storing data representing firmware or basic operating parameter values.

A hearing device according to the invention provides, that data uploaded into a hearing device,

- is consistent and delivered without any changes
- is compatible with the hearing device intended to receive the delivery and
- does not cause the hearing device to exceed existing restrictions in functionality.

Preferably, the hearing device comprises input for an electric input sound signal, a processing unit for processing the electric input sound signal and generating an electric output sound signal, and an output transducer for converting the electric output sound signal into a user-perceivable signal.

The input for the electric input sound signal may be operatively connected to in input transducer such as a microphone. The processing unit may comprise a digital signal processor for processing the electric input sound signal. The output transducer may be a loudspeaker, also called receiver, or a stimulation unit that can generate user perceivable stimulation pulses that for instance are suited to be deliver the cochlear.

The processing unit may further be configured for controlling the operation of the hearing device. It is preferred that the processing unit comprises an operation control subsystem and a sound processing subsystem.

The verifier may comprise program code stored in the static section of the memory unit and hat can be executed by the processing unit.

Because the unique key is stored in the static section of the memory, it cannot be altered and thus compromised by way of online programming. Accordingly, the verifier in combination with the unique key can reliably establish whether any second key received together with data via the data interface meets the verification criterion so that only authentic program data eventually is stored in the non-static section of the memory unit.

The data interface may be configured to be connected to a delivery subsystem which delivers the data to the hearing device, For instance, the delivery subsystem can be a computer, a server, a cloud server, a smartphone etcetera.

According to a preferred embodiment, the hearing device is a hearing aid that is configured to be head-worn by a person hard of hearing, wherein the non-static section of the memory comprises data for controlling the operation of the processing unit with respect to processing the electric input sound signal and wherein the processing unit is configured to process the electric input sound signal according to parameter data and/or program code data stored in the non-static section of the memory.

The hearing device may be configured to provide additional functionality wherein the additional functionality is provided by the processing unit and program code stored in the non-static section of the memory. The hearing device may for instance be configured to receive data representing streamed music and to convert the received data into electric output sound signals that correspond to the streamed music.

The received data is comprised in a data package that comprises a header and payload data. The header indicates the type of payload data, for instance program code, operation control parameter, hearing aid settings, control parameter values, streamed sound data.

Preferably, the hearing device is configured to provide non-activated additional functionality wherein the additional functionality is provided by the processing unit in combination with operation program code and/or operation parameter values stored in the non-static section of the memory.

The verifier preferably is configured to allow updating operating parameter values and/or operation program code if the second key does meet the verification criterion with respect to said unique key. In particular it is preferred if the hearing device is configured to activate additional functionality by way of updating operating parameter values and/or operation program code.

According to a further aspect, a system for validating online delivery of changed functionality of a hearing device is provided.

The system comprises

- a hearing device that is configured to receive data packages containing payload data that represent changes and/or updates with respect to operating parameters or operating software, e.g. program code,
- a data package that comprises payload data representing changes and/or updates with respect to operating parameters or operating software, e.g. program code (for example firmware update) of the hearing device,
- a verifier in the hearing device, and
- a delivery subsystem which delivers data packages comprising data that represent updated operating parameters and/or program code that determine the operation of the hearing device. For example, the delivery subsystem could be a computer, a server, a cloud server, a smartphone etc.

When an online delivery of a functionality to be uploaded into a hearing device, the system provides that

- The data package is consistently delivered without any changes
- The data in the data package is compatible with the hearing device intended to receive the delivery
- The data in the data package do not cause the hearing device to exceed existing restrictions in functionality.

According to yet another aspect, a method of programming a hearing device is provided. The method comprises:

- providing a hearing aid having a data interface for receiving data and a memory unit comprising a non-static section and a static section, said static section comprising a unique key being unique for the specific hearing device,
- receiving data via said data interface
- determining whether said data comprises a second key,
- and verifying the second key by determining whether said second key meets a verification criterion with respect to said unique key,
- storing received data in the non-static section of the memory unit if the received data comprises a second key that meets the verification criterion with respect to said unique key, or
- discarding received data if the second key does not meet the verification criterion with respect to said unique key.

Preferably, the received data is transmitted as a data package comprising the second key and at least one of configuration data and program code.

The method may further comprise entering a default mode if the second key does not meet the verification criterion with respect to said unique key. The default mode preferably is a sleep mode or a predetermined standard operation mode.

In preferred embodiment, the method further comprises updating operating parameter values and/or operation program code if the second key does meet the verification criterion with respect to said unique key.

A benefit of the device and the method according to the invention is to prevent unauthorized updates of a hearing device, such as upgrading a less functional hearing aid to a more functional hearing aid. An example of the received payload data could for example be firmware data.

The term 'deliver' is similar to transmit or communicate.

The hearing device updating system may further comprise a hearing device that is configured to receive data packages containing payload data that represent changes and/or updates with respect to operation parameter values and/or operation program code, a data package that comprises payload data representing changes and/or updates with respect to operation parameter values and/or operation program code, a verifier in the hearing device, and a delivery subsystem which is configured to transmit the data packages comprising data that represent updated operating parameters and/or program code that determine the operation of the hearing device.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

DETAILED DESCRIPTION

Figure 1:
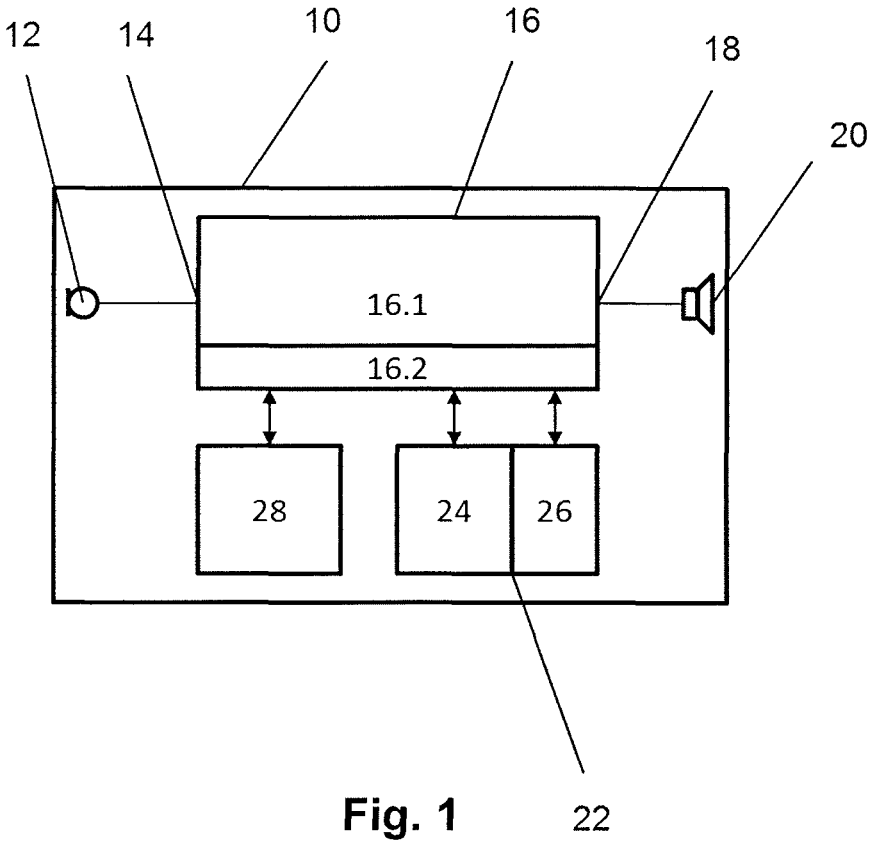
FIG. 1: is a schematic representation of a hearing device according to the invention.

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

A hearing device may include a hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. The "hearing device" may further refer to a device such as an earphone or a headset adapted to receive an audio signal electronically, possibly modifying the audio signal and providing the possibly modified audio signals as an audible signal to at least one of the user's ears. Such audible signals may be provided in the form of an acoustic signal radiated into the user's outer ear, or an acoustic signal transferred as mechanical vibrations to the user's inner ears through bone structure of the user's head and/or through parts of middle ear of the user or electric signals transferred directly or indirectly to cochlear nerve and/or to auditory cortex of the user.

The hearing device is adapted to be worn in any known way. This may include i) arranging a unit of the hearing device behind the ear with a tube leading air-borne acoustic signals or with a receiver/loudspeaker arranged close to or in the ear canal such as in a Behind-the-Ear type hearing aid or a Receiver-in-the Ear type hearing aid, and/or ii) arranging the hearing device entirely or partly in the pinna and/or in the ear canal of the user such as in a In-the-Ear type hearing aid or In-the-Canal/Completely-in-Canal type hearing aid, or iii) arranging a unit of the hearing device attached to a fixture implanted into the skull bone such as in Bone Anchored Hearing Aid or Cochlear Implant, or iv) arranging a unit of the hearing device as an entirely or partly implanted unit such as in Bone Anchored Hearing Aid or Cochlear Implant.

A hearing device may be part of a "hearing system", which refers to a system comprising one or two hearing devices, disclosed in present description, and a "binaural hearing system" refers to a system comprising two hearing devices where the devices are adapted to cooperatively provide audible signals to both of the user's ears. The hearing system or binaural hearing system may further include auxiliary device(s) that communicates with at least one hearing device, the auxiliary device affecting the operation of the hearing devices and/or benefitting from the functioning of the hearing devices. A wired or wireless communication link between the at least one hearing device and the auxiliary device is established that allows for exchanging information (e.g. control and status signals, possibly audio signals) between the at least one hearing device and the auxiliary device. Such auxiliary devices may include at least one of remote controls, remote microphones, audio gateway devices, mobile phones, public-address systems, car audio systems or music players or a combination thereof. The audio gateway is adapted to receive a multitude of audio signals such as from an entertainment device like a TV or a music player, a telephone apparatus like a mobile telephone or a computer, a PC. The audio gateway is further adapted to select and/or combine an appropriate one of the received audio signals (or combination of signals) for transmission to the at least one hearing device. The remote control is adapted to control functionality and operation of the at least one hearing devices. The function of the remote control may be implemented in a SmartPhone or other electronic device, the SmartPhone/electronic device possibly running an application that controls functionality of the at least one hearing device.

In general, a hearing device includes i) an input unit such as a microphone for receiving an acoustic signal from a user's surroundings and providing a corresponding input audio signal, and/or ii) a receiving unit for electronically receiving an input audio signal. The hearing device further includes a signal processing unit for processing the input audio signal and an output unit for providing an audible signal to the user in dependence on the processed audio signal.

The input unit may include multiple input microphones, e.g. for providing direction-dependent audio signal processing. Such directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include amplifier that is adapted to apply a frequency dependent gain to the input audio signal. The signal processing unit may further be adapted to provide other relevant functionality such as compression, noise reduction, etc. The output unit may include an output transducer such as a loudspeaker/receiver for providing an air-borne acoustic signal transcutaneous or percutaneously to the skull bone or a vibrator for providing a structure-borne or liquid-borne acoustic signal. In some hearing devices, the output unit may include one or more output electrodes for providing the electric signals such as in a Cochlear Implant.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

As can be taken from FIG. 1, the hearing device 10 comprises microphone 12 that is electrically connected to a signal input 14 of a processing unit 16. Microphone 12 provides an electric input sound signal to processing unit 16. The electric input sound signal represents sound captured or picked up by microphone 12.

Processing unit 16 is configured to process the electric input sound signal in order to generate an electric output sound signal that is provided at a signal output 18 of processing unit 16. Signal output 18 is operatively connected to an output transducer 20. The output transducer can be a speaker or receiver that converts the electric output sound signal into acoustic sound that can be perceived by a user.

Alternatively, the output transducer can be an electrode array of a cochlear implant for delivering stimulation pulses to the cochlea.

Likewise, signal input 14 of processing unit 16 can be operatively connected to other sources of electric input sound signals such as telecoils, Bluetooth receivers, Wi-Fi receivers or the like.

Processing unit 16 is configured to process electric input sound signals according to operation program code and/or operation parameter values stored in a memory unit 22.

Memory unit 22 comprises a non-static section 24 and a static section 26. Both sections may comprise at least a part of the operation program code and/or the operating parameter values or other configuration data.

Data stored in the static memory section 26 cannot be upgraded by way of a user update. In a preferred embodiment data stored in the static section 26 of memory 22 cannot be altered at all.

Data stored in non-static section 24 of memory unit 22 can be user updated. In particular, non-static section 24 of memory unit 22 may comprise data representing program code updates, operation parameter value updates and/or other configuration data updates.

Hearing aid 10 further comprises a data interface 28 for receiving data. Data interface 28 can be a wireless transceiver or receiver for wireless data communication with an external transmitter or transceiver. Data interface 28 is configured to receive data signals comprising data, in particular data packages comprising data. Data packages comprise a header and payload data. The header comprises data that indicates which type of data the payload data is. Data received via data interface 28 is at least tentatively stored in non-static section 24 of memory unit 22.

Receiving data via data interface 28 and storing data in the non-static section 24 of memory unit 22 is controlled by processing unit 16.

Processing unit 16 comprises a sound processing subsystem 16.1 and an operation control subsystem 16.2. Operation control subsystem 16.2 controls among others reception of data via data interface 28 in storing data in non-static section 24 of memory unit 22.

Sound processing subsystem 16.1 processes the electric input sound signal in order to produce the electric output sound signal.

As indicated above, operation of processing unit 16 and thus of sound processing subsystem 16.1 and operation control subsystem 16.2 is controlled by operation program code and operation parameter values stored in memory unit 22.

Part of the operation program code forms program code defining the operation of the veryfier and thus is referred to as a verifier operation program code 44. The verifier operation program code 44 is stored in the static section 26 of memory unit 22. Part of the operating parameter values is a unique key 42 that is unique for a particular hearing device 10. The unique key 42 is also stored in the static section 26 of memory unit 22.

Alternatively, the unique key 42 may be hardcoded or printed into a chip or an integrated circuit The verifier operation program code 44 is configured to be processed by the operation control subsystem 16.2 processing unit 16 that can thus act as a verifier.

The verifier defined by verifier operation program code 44 stored in the static section 26 is configured to determine whether or not data received via data interface 28 and stored in the non-static section 24 of a memory unit 22 comprises a second key.

The verifier operation program code 44 is further configured to cause operation control subsystem 16.2 to determine whether the second key received together with data meets a verification criteria with respect to the unique key stored in the static section 26.

The operation control program code stored in the static section 26 is further configured to cause the operation control subsystem 16.2 to discard received data in the non-static section if the second key received together with the other data does not meet the verification criterion with respect to the unique key. Discarding received data means that the data received is not used, applied or activated.

In particular, the verifier as defined by the verifier operation program code 44 is configured to analyse a header of a data package received by data interface 28 in order to determine whether the payload data of the data package comprises data representing operation program code updates and/or operation parameter value updates. The verifier is is configured to accept updated operation program code and/or updated operation parameter values only if the second key 40 received together with the data package and stored in non-static section 24 of memory unit 22 meets the predetermined verification criterion with respect to the unique key 42 stored in the static section 26 of memory unit 22.

Updated operation program code and/or updated operation parameter values are stored in the non-static section 24 of memory unit 22 and cause the operation control subsystem 16.2 and/or the sound processing subsystem 16.1 of processing unit 16 to control operation of the hearing device and processing electric input sound signals, respectively, in accordance with the updated operation program code and/or the updated operation parameter values.

The verifier as defined by the verifier operating program 44 stored in the static section 26 of memory unit 22 is further configured to cause hearing device 10 to enter into a default operation mode in case the second key does not meet the predefined verification criterion with respect to the unique key. The default operation mode may for example be a sleep mode or a standard operation mode.

The verifier as defined by the verifier program code 44 stored in the static section 26 of memory unit 22 thus provides that data uploaded to the hearing device 10 via data interface 28 is consistent and is delivered without changes. The verifier further provides that data uploaded to the hearing device 10 is compatible with the hearing device 10 and that the hearing device 10 is intended to receive the data, in particular to receive a particular operation program code update and/or an operation parameter update. Further, the verifier provides that data uploaded to hearing device 10 does not cause the hearing device 10 to exceed predefined restrictions in functionality.

According to a preferred embodiment, keys received via data interface 28 are accompanied with a signature that ensures that the received key is not tampered. The verification of the key can be based on standard cryptographic methods.

Figure 2:
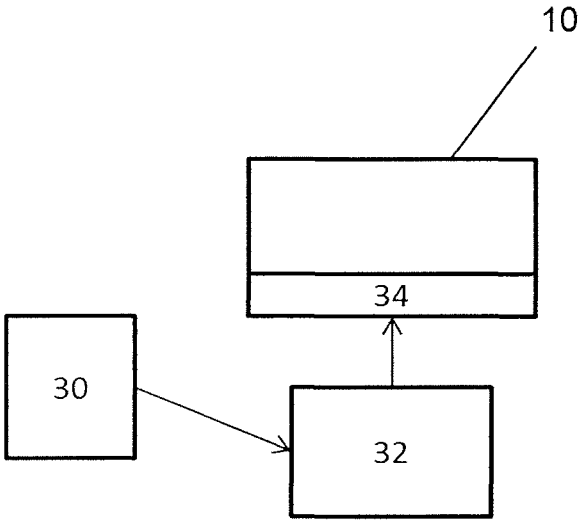
FIG. 2: is a schematic representation of a software delivery and update process.

FIG. 2 illustrates that data package delivery to hearing device typically is done by a system where a data package 30 is first played out to a delivery subsystem 32. Delivery subsystem 32 can be a computer, a server, a cloud server or a smartphone or the like that is configured to wirelessly or wire-bound communicate with data interface 28 of hearing device 10.

Operation of the system in FIG. 2 is as follows:

As shown above, the memory unit 22 of the hearing device is divided into two sections, i.e. a static section 26 and a non-static section 24. The static section 26 comprises an unique key 42 (cf. FIG. 4), i.e. a key which is unique for the specific hearing device 10. Additionally, the static section 26 comprises a verifier or at least verifier operation program code 44 that causes the processing unit to act as a verifier.

Data in non-static section 24 of the memory unit 22 is configured to be updated/changed, and the information which is stored in this non-static section 24 is configured with the second key 40.

Alternatively, for each time the non-static section 24 is being updated the previous second key 40 is deleted and a new second key 40 is stored together with the new data representing operation program code and/or operation parameter values.

Alternatively, The update may include the new second key 40 and which is being validated to the previous second key 40, and if the two keys are identical or fulfils a validation criteria then the new second key 40 is stored together with the new data representing operation program code and/or operation parameter values.

The verifier operation program code 44 is configured to cause the processing unit 16 to compare the unique key 42 and the new second key 40 according to a cryptographic model, and if a matching criteria is fulfilled then the program code update and/or the operation parameter value update is accepted by the hearing device. However, if no match is determined then the hearing device will not accept the update and properly enter in a certain mode, e.g. a sleep mode, a standard operation mode or the like.

The delivery subsystem 32 writes changed payload data representing changed operation program code data and/or changed operation parameter values contained in the data package to the hearing device 10. After these data have been written to the hearing device 10, a part of the hearing device 10, namely the verifier 44, which has been left untouched, verifies that the changes match the hearing device intended. Second keys 40 residing in the written part (the non-static section) must match unique keys 42 in the untouched part (the static memory). Accompanying the second keys 40, a signature is present to verify that the particular second key is not tampered. This verification is based on standard cryptographic methods.

Figure 3:
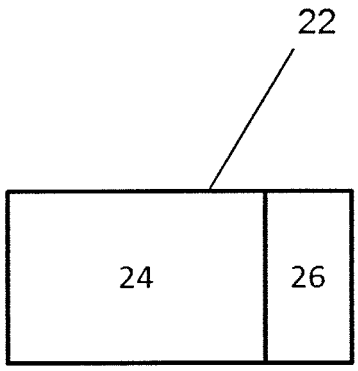
FIG. 3: is a schematic representation of a hearing device memory partition

FIG. 3 illustrates the basic partition scheme of memory unit 22 that comprises a non-static section 24 and/or a static section 26.

Figure 4:
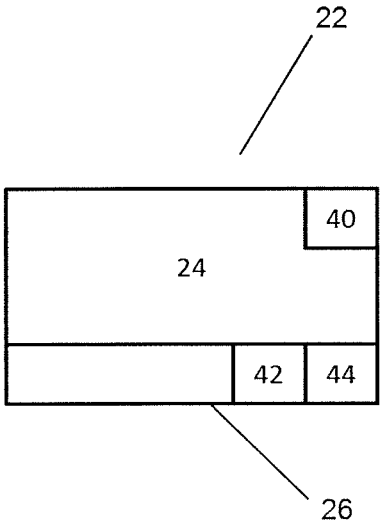
FIG. 4: is a schematic representation of a memory layout according to the invention.

FIG. 4 illustrates, that the non-static section 24 of memory unit 22 comprises data representing the second key 40 received together with data or data packages, respectively, via data interface 28.

The static section 26 comprises at least one unique key 42 and the verifier operation program code 44 defining the operation of the verifier.

Static section 26 of memory unit 22 may comprise further data such as further operation program code and/or operation parameter values that cannot be updated by a user. Likewise, non-static section 24 of memory unit 22 also may comprise further operating program code and/or operation parameter values, in particular updated operation program code and/or updated operation program code and/or updated operation program values. Further non-static section 24 may comprise further data, for instance data representing electric sound signals to be processed by the sound processing subsystem 16.1 of processing unit 16.

| | |
|---|---|
| hearing device | 10 |
| microphone | 12 |
| signal input | 14 |
| processing unit | 16 |
| processing subsystem | 16.1 |
| operation control subsystem | 16.2 |
| signal output | 18 |
| output transducer | 20 |
| memory unit | 22 |
| non-static memory section | 24 |
| static memory section | 26 |
| data interface | 28 |
| data package | 30 |
| delivery subsystem | 32 |
| second key | 40 |
| unique key | 42 |
| verifier operation program code | 44 |

The invention claimed is:

1. A hearing device comprising:

a data interface for receiving data;

a memory unit or partition for storing data, said memory unit comprising:

a non-static section, and a static section, said static section comprising a unique key being unique for the specific hearing device, and a verifier comprising program code stored in the static section of the memory unit or partition, the verifier being configured to process said unique key and a second key contained in data received via said data interface in order to determine whether said second key meets a verification criterion with respect to said unique key, and to discard received data in the non-static section if the second key contained in said received data does not meet the verification criterion with respect to said unique key.

2. The hearing device according to claim 1, further comprising an input for an electric input sound signal, and the processing unit which is for processing the electric input sound signal and generating an electric output sound signal,. and an output transducer for converting the electric output sound signal into a user-perceivable signal, said processing unit being further configured for controlling the hearing device.

3. The hearing device according to claim 1, wherein the program code is configured to be executed by the processing unit.

4. The hearing device according to claim 1, wherein the hearing device is a hearing aid that is configured to be head-worn by a person hard of hearing, wherein the non-static section of the memory unit or partition comprises data for controlling the operation of the processing unit with respect to processing the electric input sound signal and wherein the processing unit is configured to process the electric input sound signal according to parameter data and/or program code data stored in the non-static section of the memory partition or unit.

5. The hearing device according to claim 1, wherein the hearing device is configured to provide non-activated additional functionality wherein the additional functionality is provided by the processing unit in combination with operation program code and/or operation parameter values stored in the non-static section of the memory unit or partition.

6. The hearing device according to claim 1, wherein the verifier is configured to allow updating operating parameter values and/or operation program code if the second key does meet the verification criterion with respect to said unique key.

7. The hearing device according to claim 5, wherein the hearing device is configured to activate additional functionality by way of updating operating parameter values and/or operation program code.

8. The hearing device according to claim 1, wherein received data is comprised in a data package that comprises a header and payload data, wherein the header indicates the type of payload data.

9. A hearing device updating system comprising:

a hearing device according to claim 1, said hearing device being configured to receive data packages containing payload data that represent changes and/or updates with respect to operation parameter values and/or operation program code;

a data package that comprises payload data representing changes and/or updates with respect to operation parameter values and/or operation program code; and a delivery subsystem which is configured to transmit the data packages comprising data that represent updated operating parameters and/or program code that determine the operation of the hearing device.

10. The hearing device according to claim 2, wherein the hearing device is a hearing aid that is configured to be head-worn by a person hard of hearing, wherein the non-static section of the memory unit or partition comprises data for controlling the operation of the processing unit with respect to processing the electric input sound signal and wherein the processing unit is configured to process the electric input sound signal according to parameter data and/or program code data stored in the non-static section of the memory partition or unit.

11. The hearing device according to claim 3, wherein the hearing device is a hearing aid that is configured to be head-worn by a person hard of hearing, wherein the non-static section of the memory unit or partition comprises data for controlling the operation of the processing unit with respect to processing the electric input sound signal and wherein the processing unit is configured to process the electric input sound signal according to parameter data and/or program code data stored in the non-static section of the memory partition or unit.

12. The hearing device according to claim 2, wherein the hearing device is configured to provide non-activated additional functionality wherein the additional functionality is provided by the processing unit in combination with operation program code and/or operation parameter values stored in the non-static section of the memory unit or partition.

13. The hearing device according to claim 3, wherein the hearing device is configured to provide non-activated additional functionality wherein the additional functionality is provided by the processing unit in combination with operation program code and/or operation parameter values stored in the non-static section of the memory unit or partition.

14. The hearing device according to claim 4, wherein the hearing device is configured to provide non-activated additional functionality wherein the additional functionality is provided by the processing unit in combination with operation program code and/or operation parameter values stored in the non-static section of the memory unit or partition.

15. The hearing device according to claim 2, wherein the verifier is configured to allow updating operating parameter values and/or operation program code if the second key does meet the verification criterion with respect to said unique key.

* * * * *